US009578915B2

(12) United States Patent
Pfanner et al.

(10) Patent No.: US 9,578,915 B2
(45) Date of Patent: Feb. 28, 2017

(54) FOREHEAD BAND

(71) Applicant: PFANNER SCHUTZBEKLEIDUNG GMBH, Hohenems (AT)

(72) Inventors: Anton Pfanner, Hohenems (AT); Martin Greber, Goetzis (AT)

(73) Assignee: PFANNER SCHUTZBEKLEIDUNG GMBH, Hohenems (AT)

( * ) Notice: Subject to any disclaimer, the term of this patent is extended or adjusted under 35 U.S.C. 154(b) by 76 days.

(21) Appl. No.: 14/391,529

(22) PCT Filed: Apr. 19, 2013

(86) PCT No.: PCT/EP2013/058194

§ 371 (c)(1),
(2) Date: Oct. 9, 2014

(87) PCT Pub. No.: WO2013/156604

PCT Pub. Date: Oct. 24, 2013

(65) Prior Publication Data

US 2015/0059057 A1 Mar. 5, 2015

(30) Foreign Application Priority Data

Apr. 20, 2012 (DE) ..... 10 2012 103 528

(51) Int. Cl.
*A42B 3/04* (2006.01)
*A42B 3/10* (2006.01)
(Continued)

(52) U.S. Cl.
CPC ..... *A42B 3/0406* (2013.01); *A42B 3/10* (2013.01); *A42C 5/02* (2013.01); *A42B 3/14* (2013.01)

(58) Field of Classification Search
CPC ..... A42B 3/10; A42B 3/14; A42C 5/02
See application file for complete search history.

(56) References Cited

U.S. PATENT DOCUMENTS 2,134,274 A * 10/1938 Cavanagh ..... A42C 5/02 2/181
2,371,712 A * 3/1945 Scholl ..... A42B 3/14 2/419

(Continued)

FOREIGN PATENT DOCUMENTS

DE 102010027012 1/2012
DE 102010027014 A1 1/2012

(Continued)

OTHER PUBLICATIONS

International Search Report and Written Opinion dated Jul. 9, 2013, from the corresponding PCT/EP2013/058194.

*Primary Examiner* — Shaun R Hurley
*Assistant Examiner* — Andrew W Sutton
(74) *Attorney, Agent, or Firm* — Hassan Abbas Shakir; Katten Muchin Rosenman LLP

(57) ABSTRACT

A forehead band attaches to a head band of an interior fitting assembly of a protective helmet is described. The forehead band includes a strip-shaped support which is provided with a holder for removably fixing the forehead band to the head band. The support is covered with a sweat-absorbing overlay. The holder has tubular supporting connection pieces integrally formed on the support and designed to engage into openings of the head band. The overlay has complementary longitudinal edges and is provided with openings for releasably receiving the supporting connection pieces. The overlay is washable with or without the support. The entire forehead band is designed so that the overlay or its support or both can be readily replaced.

16 Claims, 8 Drawing Sheets

(51) Int. Cl.
*A42C 5/02* (2006.01)
*A42B 3/14* (2006.01)

(56) References Cited

U.S. PATENT DOCUMENTS

| | | | | | |
|---|---|---|---|---|---|
| 2,628,361 | A * | 2/1953 | Heyck | A42C 5/02 | 2/181 |
| 3,685,055 | A | 8/1972 | Militello | | |
| 3,758,889 | A | 9/1973 | Erb | | |
| 4,130,902 | A * | 12/1978 | Mackenroth, III | A42B 1/008 | 2/171.2 |
| 5,826,279 | A * | 10/1998 | Tencer | A42B 3/10 | 2/181 |
| 8,393,014 | B1 * | 3/2013 | Follo | A42C 5/02 | 2/181 |
| 2004/0093660 | A1 * | 5/2004 | Bostock | A42B 1/08 | 2/416 |
| 2005/0034214 | A1 * | 2/2005 | Nunnery | A42C 5/02 | 2/181 |
| 2005/0193470 | A1 * | 9/2005 | Nalls | A42C 5/02 | 2/181 |
| 2006/0010568 | A1 * | 1/2006 | Wiles | A42B 3/10 | 2/181 |

FOREIGN PATENT DOCUMENTS

| | | | | |
|---|---|---|---|---|
| GB | 124654 | A | 4/1919 | |
| GB | 1012001 | A * | 12/1965 | A42B 3/10 |
| JP | 2004270040 | A | 9/2004 | |

* cited by examiner

FOREHEAD BAND

BACKGROUND OF THE INVENTION

1. Field of the Invention

The invention relates to a forehead band to be attached to a head band of an interior fitting assembly of a protective helmet.

2. Description of the Rotated Art

A protective helmet and an interior fitting for a protective helmet are known from the documents DE 10 2010 027 012 A1 or DE 10 2010 027 014 A1 which both go back to the applicant. According to the illustration in the accompanying FIG. 10 showing the interior fitting from the latter document a support cage 42', a head band 44', and a neck band 46' together form an interior fitting assembly 40' fixable to a helmet shell for supporting and retaining a protective helmet on the head of a wearer. On the inner side of the head band 44', i.e. on the side facing the forehead of a wearer, obviously, a forehead band 20' is attached to the head band 44' which, however, is not mentioned anywhere in the texts of the two abovementioned documents. The length of the forehead band 20' is determined so that it covers two joints 56' through which the head band 44' is respectively connected to a part of the neck band 46' with its two free ends. It is feasible that the forehead band 20' consists of a piece of padding material as mentioned elsewhere in the documents in connection with the support cage 42' and a support shell. There is no information about the type of fixation of the forehead band 20' to the head band 44' to be found in the two documents since the forehead band 20' is not even mentioned there. However, it is possible that the forehead band 20' is, as usually, releasably attached to the head band 44' with the aid of a hook-and-loop tape. The inner side of the head band 44' adjacent to the forehead of the wearer is probably the section of the interior fitting assembly 40' most significantly exposed to sweat because on the human head sweat formation is usually the most distinct on the forehead. If the forehead band 20' is, as assumed, a piece of padding material it will become soaked with sweat which may give rise to the risk of a frontal sinusitis or other impairment to health at changing temperatures in the area of the head band 44' if the helmet is repeatedly put on and taken off. Intense sweat flow may, in addition, result in a premature failure of the holder of the forehead band 20' so that the forehead band 20' will be lost and the protective helmet will then have to be worn with the blank head band 44'.

From the JP 2004-270040 A a forehead band is known which is attached to a head band of a helmet. An auxiliary band of the helmet is covered by a sweat-absorbing component.

SUMMARY OF THE INVENTION

It is the object of the invention to overcome the problems described above based on a forehead band of the type described in the beginning.

According to the invention, the object is solved by a forehead band comprising a strip-shaped support provided with a holder for releasably fixing the forehead band on the head band and coverable or covered with an overlay made of a sweat-absorbing material on at least a side facing away from the head band, wherein the holder comprises tubular supporting connection pieces designed to non-positively or positively engage in openings of the head band and integrally formed on the support on a rear face of the support which can be brought in contact with the head band.

The forehead band according to the invention is not simply a piece of padding material or the like as according to the state of the art, but comprises a strip-shaped support provided with an overlay made of a sweat-absorbing material. In this way the holder can, to a large extent, be designed independent of the sweat-absorbing material and, in particular, be relocated on a side of the support not exposed to sweat. Here, it is sufficient if the forehead band is covered by an overlay made of a sweat-absorbing material at least on a side facing away from the head band. The fixation of the overlay on the support may be uninfluenced by the holder of the support on the head band itself and designed so that it is not releasable by exposure to sweat. The strip-shaped support covered by an overlay made of a sweat-absorbing material is usefully provided with a holder designed so that the support can be fixedly connected to the head band, however, can also be readily removed from the head band without problems. Thereby it is rendered possible to design the entire forehead band as a replaceable or exchangeable part which can be released and connected to the protective helmet again as required by means of the support of the protective helmet, be it to temporarily replace a sweaty forehead band with a dry forehead band until it can again be replaced by the forehead band dried in the meantime or be it to substitute a worn forehead band with a replacement forehead band. For this purpose the forehead band may be kept in store as a spare part and included in a specific number when the protective helmet is sold. The support can be buttoned into openings already present in the head band for another purpose, namely, e.g., as ventilation openings, via the supporting connection pieces. To remove the forehead band from the head band the support is simply unbuttoned again. Owing to the non-positive or positive engagement of the supporting connection pieces in openings of the head band the holder renders clamping or a kind of snap-on connection of the supporting connection pieces in openings of the support band possible in a simple manner which may, as mentioned, already be present there for other purposes.

In one embodiment of the forehead band according to the invention the supporting connection pieces are respectively designed so as to be elastically resilient at their free ends and respectively provided with at least one outwardly protruding snap tab. In this way the establishment of a snap-on connection of the abovementioned type is rendered possible in a simple manner. The supporting connection pieces will automatically engage in associated openings in the head band owing to their elastically resilient free ends, wherein the openings, in turn, may also be already present for other purposes.

In a further embodiment of the forehead band according to the invention the support is provided with at least one air aperture alignable with one of the openings of the head band between the snap-on stubs. Here, a sufficient ventilation of the forehead may be achieved via openings already present in the head band for this or another purpose irrespective of the strip-shaped supports disposed between the forehead of the wearer of a helmet and the head band.

In a further embodiment of the forehead band according to the invention the overlay comprises a textile blank. The material of the textile blank may be selected for the purpose of an optimum sweat absorption.

In a further embodiment of the forehead band according to the invention the overlay is dimensioned so that it covers or may cover the support on all sides. In this way the sweat absorption capability of the forehead band is significantly increased.

In a further embodiment of the forehead band according to the invention the overlay comprises longitudinal edges corrugated complementarily relative to each other the wave crests of which are respectively provided with an opening for receiving one of the supporting connection pieces. This facilitates the production of the forehead band since the overlay only has to be a correspondingly designed textile blank not requiring any additional holder for its fixation to the strip-shaped support. The textile blank only has to be threaded onto the supporting connection pieces in the area of its openings. The complementary design of the corrugated longitudinal edges renders a complete covering of the rear face of the strip-shaped support possible while maintaining an optimum mutual fixation and support of the corrugated longitudinal edges.

In a further embodiment of the forehead band according to the invention the holder comprises two pins protruding into a recess of the support for fixing the ends of the corrugated longitudinal edges of the overlay on each end of the support. In this way, a simple fixture for the ends of the overlay is attained on the support without other fixation means being required in addition to the support.

In a further embodiment of the forehead band according to the invention the support is a flexible formed component made of a plastic material. The support may thus, e.g., be manufactured as an injection moulded component. Usefully, the overlay is lifted off the support strip if it is to be laundered, however, the support is advantageously formed of a material rendering laundering of the support together with the overlay possible in a simple manner.

BRIEF DESCRIPTION OF THE DRAWINGS

Embodiments of the invention will be described in more detail below with reference to the drawings in which.

DETAILED DESCRIPTION OF THE INVENTION

Figure 1:
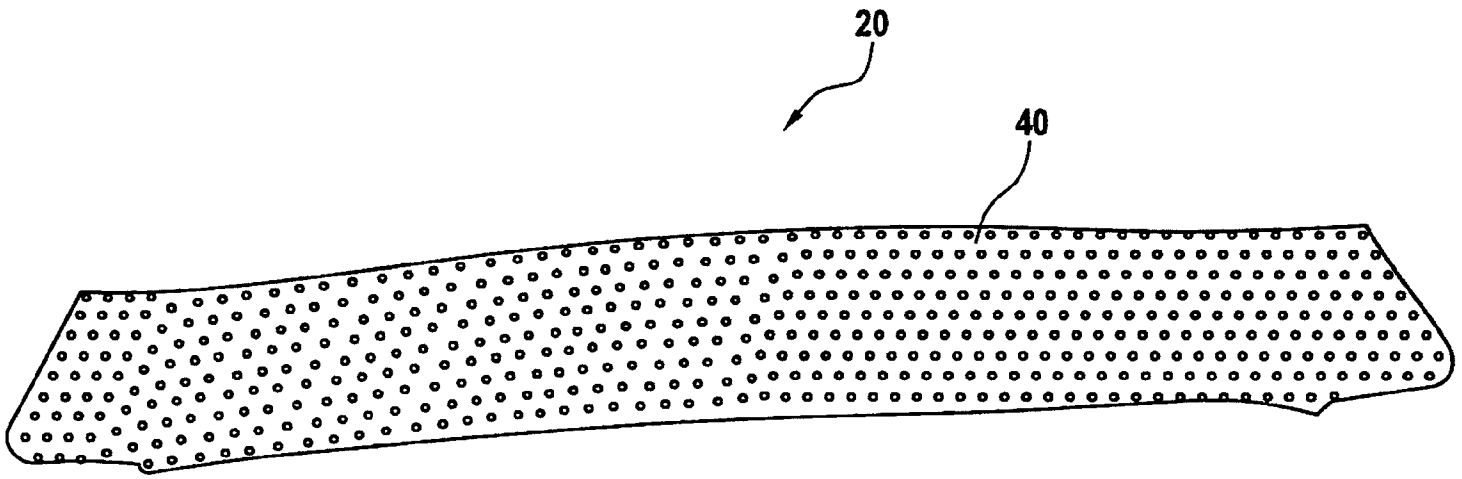
FIG. 1 shows a forehead band according to the invention in a front view.
Figure 3:
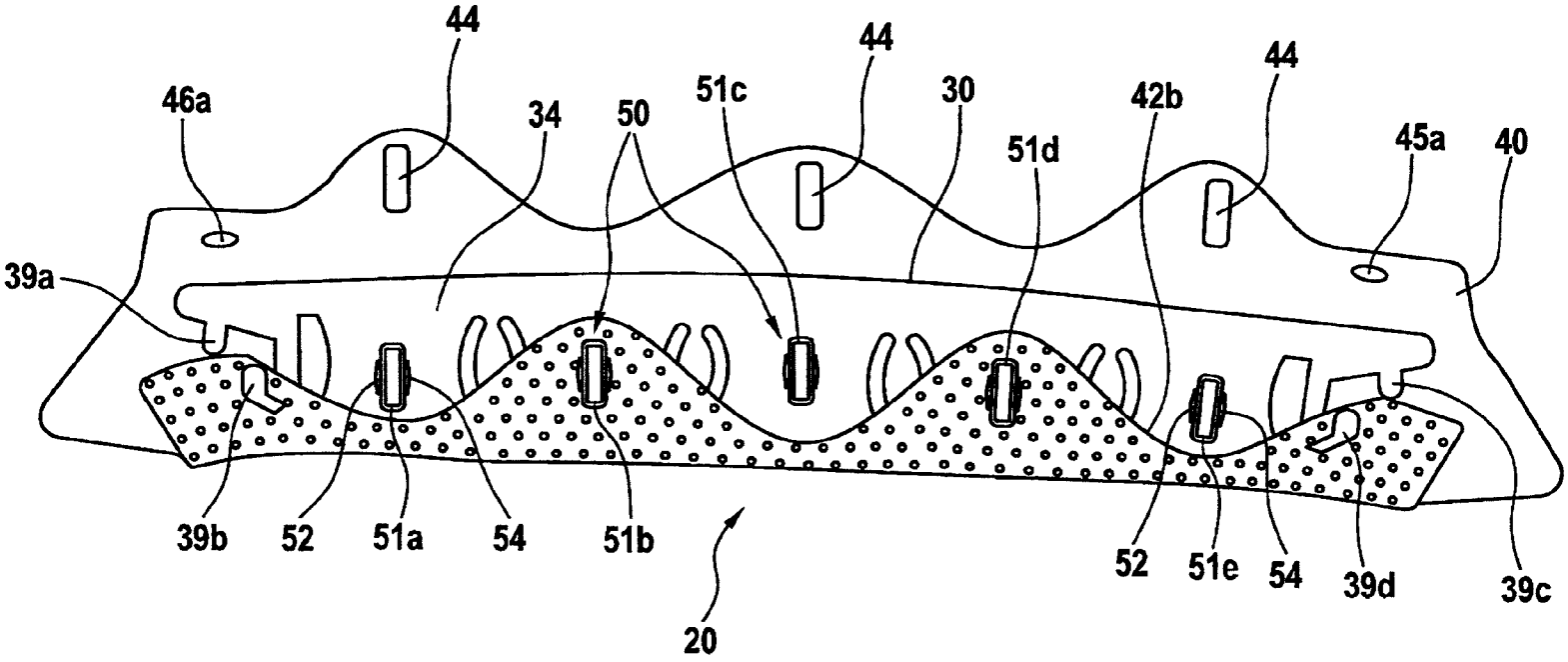
FIG. 3 shows the forehead band in the same view as in FIG. 2, however, with the overlay halfway unbuttoned.
Figure 4:
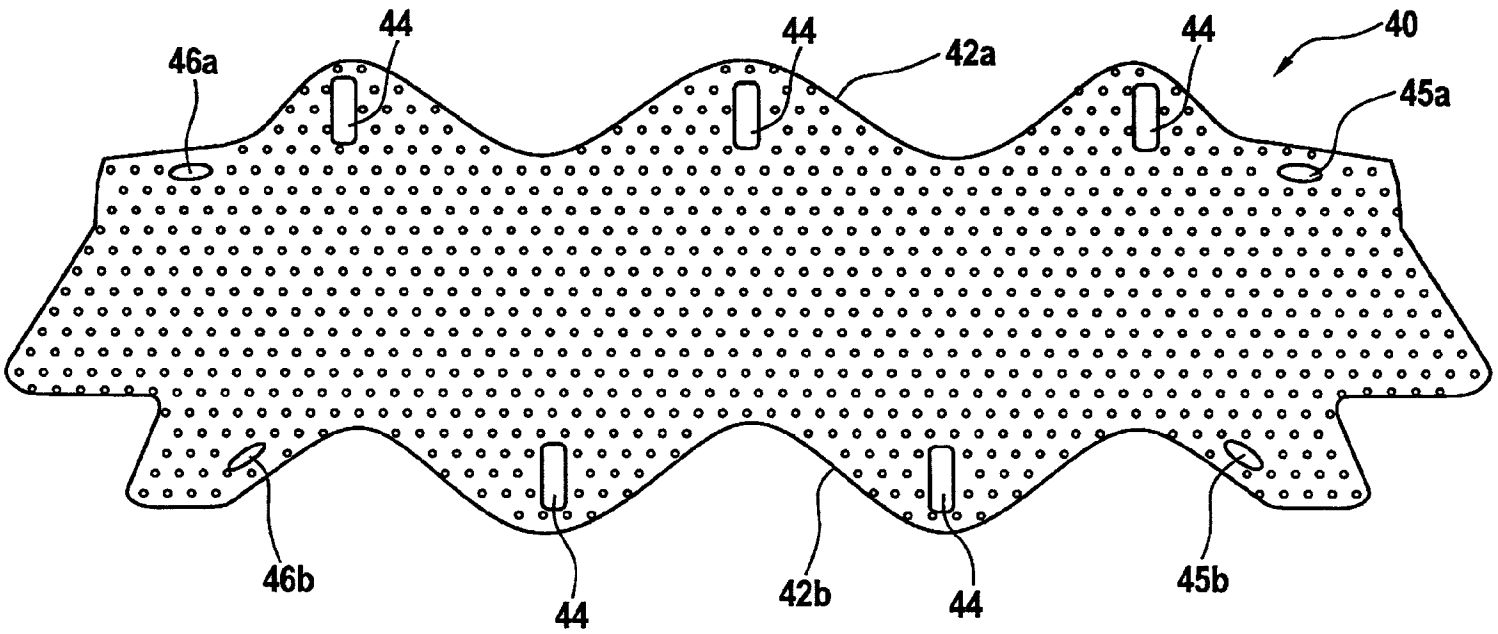
FIG. 4 shows the overlay according to FIG. 3 in a fully unbuttoned state in a top view and without a support of the overlay partly visible in FIG. 3.
Figure 5:
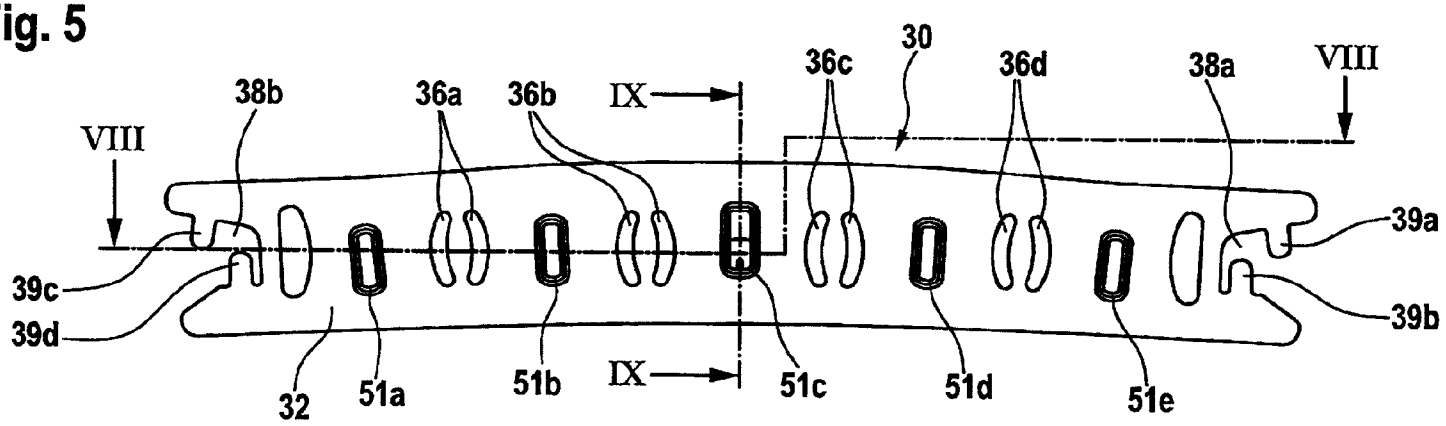
FIG. 5 shows the support as a detail in a front view.
Figure 6:
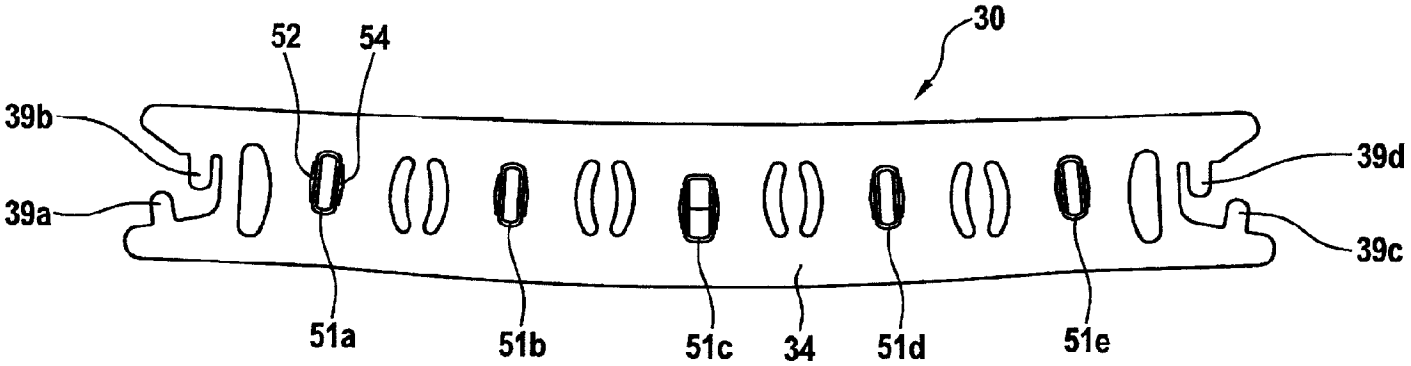
FIG. 6 shows the support according to FIG. 5 in a rear view.
Figure 10:
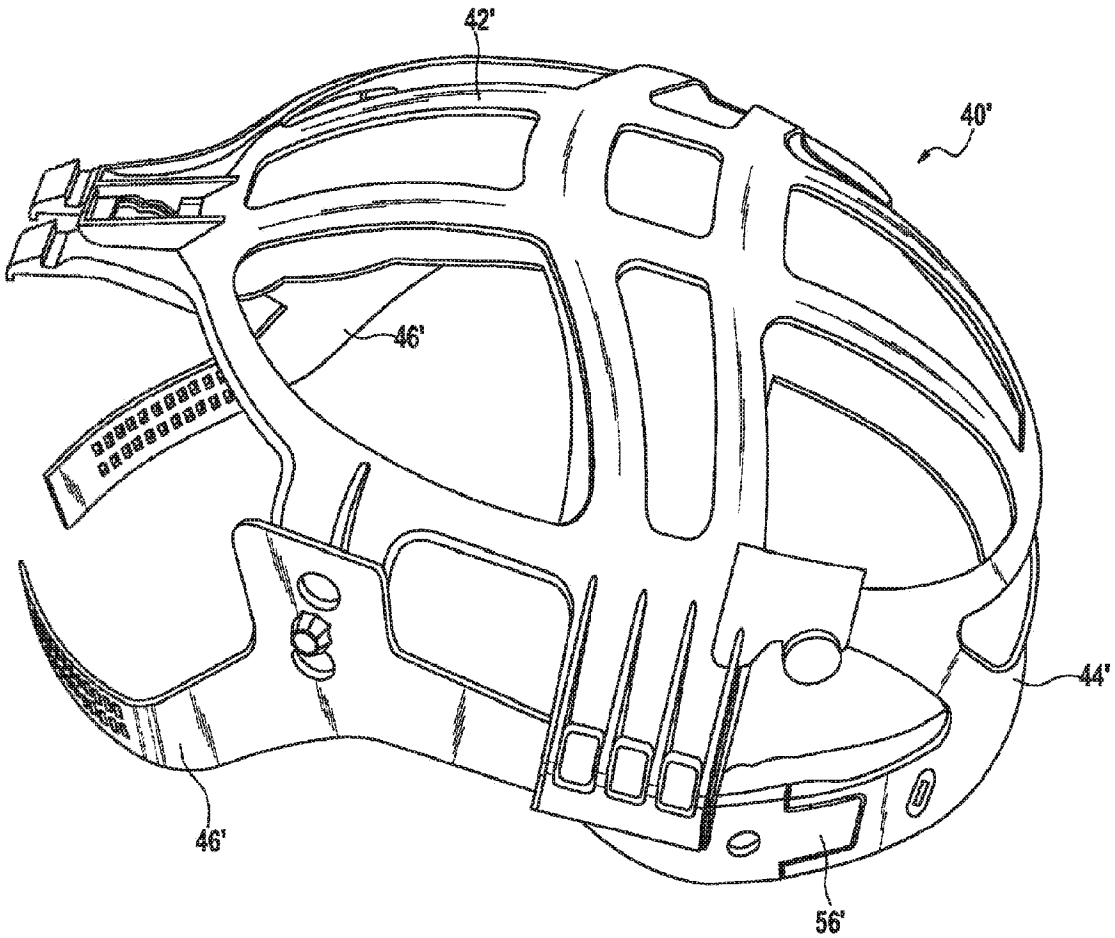
FIG. 10 PRIOR ART
FIG. 10 shows a known interior fitting assembly of a protective helmet in a perspective view.

In FIG. 1, a forehead band according to the invention is shown in a plan view and, as a whole, designated by 20. The forehead band 20 is intended to be attached to a head band of an interior fitting assembly as shown, for example, in FIG. 10. In FIG. 10, the interior fitting assembly is designated by 40', and the head band is designated by 44'. The forehead band 20 comprises a strip-shaped support 30. FIG. 5 shows the support 30 of the forehead band 20 as a detail in a plan view on its front side. FIG. 6 shows the support 30 in a rear view. The support 30 is provided with a holder 50 for releasably fixing the forehead band 20 on a head band such as the head band 44'. The support 30 is covered by an overlay 40 made of a sweat-absorbing material at least on its front side 32 visible in FIG. 5. However, in the embodiment of the forehead band 20 according to the invention shown in the drawings the overlay 40 is dimensioned so that it covers the support 30 on all sides. This support 30 covered by the overlay 40 on all sides is shown in a front view in FIG. 1 and in a rear view in FIG. 2. In FIG. 3 the overlay 40 is shown halfway uncoiled from the support 30. FIG. 4 shows a complete uncoilment of the overlay 40 without the support 30.

Figure 8:
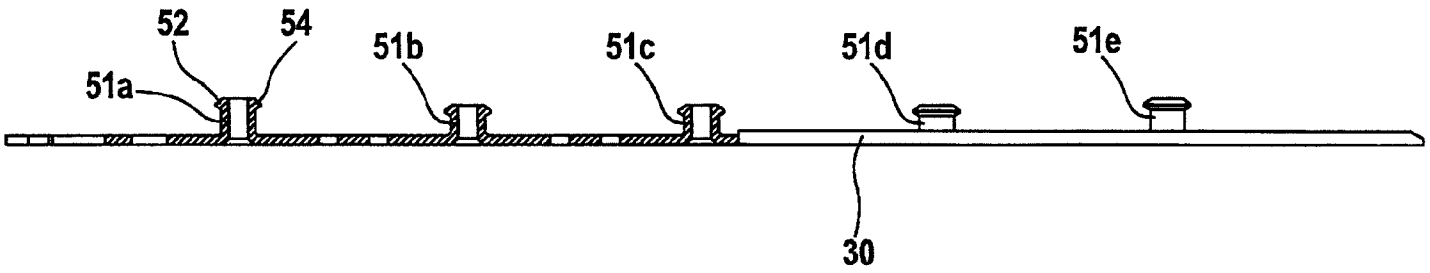
FIG. 8 shows the support in a partial longitudinal sectional view along the line VIII-VIII in FIG. 5.
Figure 9:
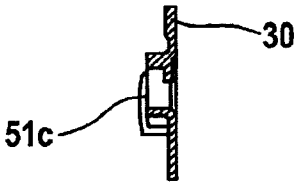
FIG. 9 shows the support in a cross-sectional view along the line IX-IX in FIG. 5.

The holder 50 comprises five tubular supporting connection pieces 51*a*, 51*b*, 51*c*, 51*d* and 51*e* which are integrally formed on a rear face 34 of the support 30 which is the side of the support which can be brought in contact with the head band. In FIG. 8 which shows a partial longitudinal sectional view of the support 30 along the line VIII-VIII in FIG. 5, and in FIG. 9, which shows the support 30 in of a cross sectional view along the line IX-IX in FIG. 5, the tubular supporting connection pieces 51*a*-51*e* forming the holder 50 can be seen the best. The supporting connection pieces 51*a*-51*e* are designed to non-positively or positively engage in openings of the head band. In the forehead band 20 shown as an embodiment here the supporting connection pieces 51*a*-51*e* are designed to positively engage in openings of the head band. For this purpose, the supporting connection pieces 51*a*-51*e* are respectively designed so as to be elastically resilient at their free end and respectively provided with at least one snap tab 52 and 54 protruding to the outside. In the embodiment of the forehead band 20 shown here each supporting connection piece 51*a*-51*e* comprises two snap tabs 52, 54 protruding to the outside. The tubular supporting connection pieces 51*a*-51*e* are rectangular in the cross section. The snap tabs 52, 54 are integrally formed on the opposing longitudinal sides of the cross section of each supporting connection piece. The tubular supporting connection pieces 51*a*-51*e* have a height H respectively dimensioned so that, taking into account the thickness of the overlay 40 on the rear face 34, if the supporting connection pieces are inserted into openings complementary to their cross section formed in the head band all the way to the stop, i.e. the support 30 abuts to the head band with the rear face 34 via the overlay 40, the snap tabs 52, 54 of each supporting connection piece rest adjacent to the associated opening on the opposite side of the head band. This latched position of each supporting connection piece is releasable by compressing it with the fingers or with a tool to the extent that the snap tabs 52, 54 will be released from the front side of the head band so that the support 30 can be pulled off the head band.

Figure 7:
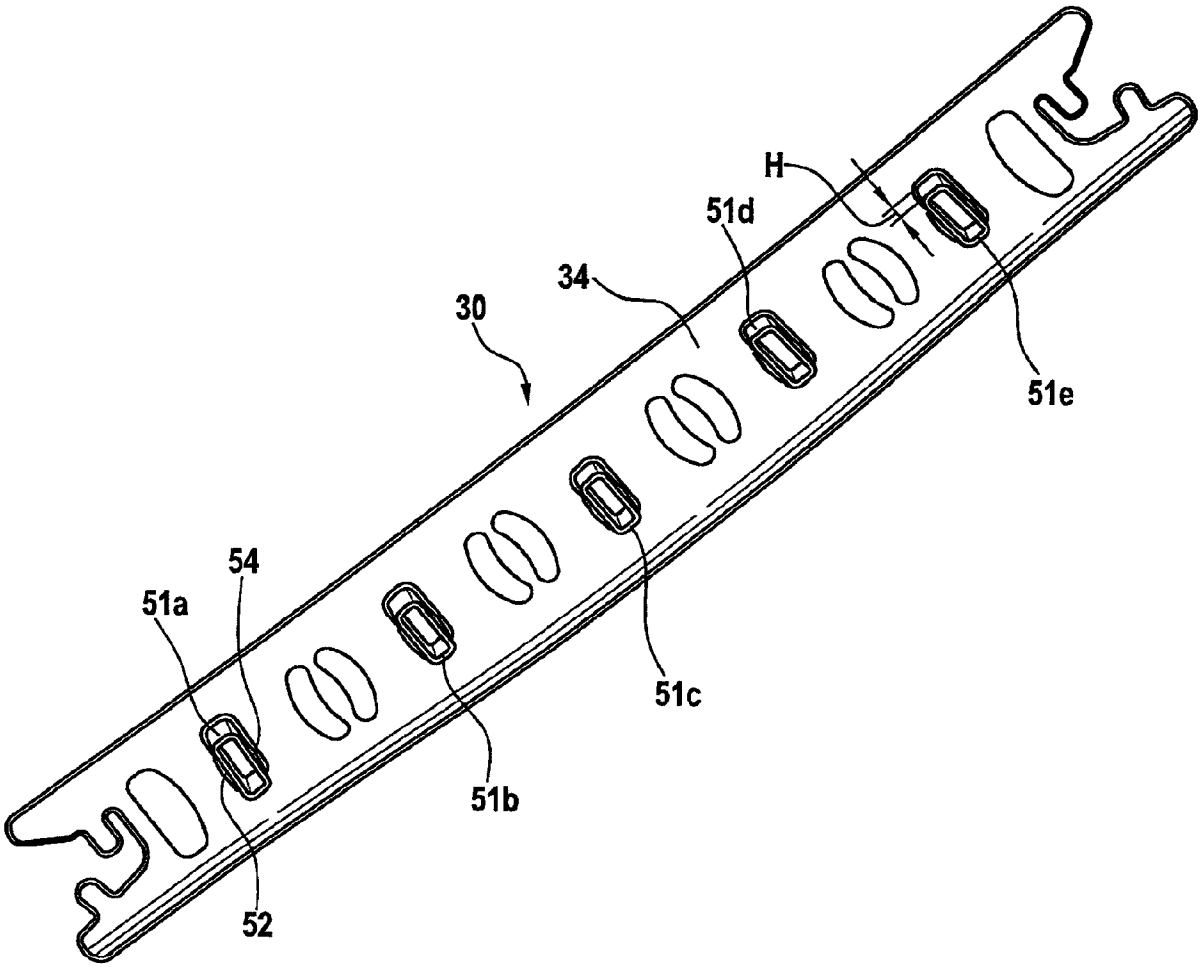
FIG. 7 shows the support according to FIG. 6 in a perspective illustration.

The support 30 is respectively provided with an air aperture 36*a*, 36*b*, 36*c* or 36*d* between two of the supporting connection pieces 51*a*-51*e*. Each of these air apertures 36*a*-36*d* is provided with a central bridge for reasons of stability as can be seen in FIGS. 5-7. Each of the air apertures 36*a*-36*d* can be aligned with one of the openings of the head band.

The overlay 40 comprises a textile blank shown in its entirety in FIG. 4. In FIG. 4 it can further be seen that the overlay 40 comprises longitudinal edges 42*a*, 42*b* corrugated complementarily relative to each other. Corrugated complementarily relative to each other means that each wave crest of the longitudinal edge 42*a* is opposed by a wave trough of the longitudinal edge 42*b* and vice versa. Each wave crest is provided with an opening 44 for receiving one of the supporting connection pieces 51*a*-51*e*. Further, the overlay 40 is provided with two holes 45*a*, 45*b* or 46*a*, 46*b* on each end adjacent to the longitudinal edges 42*a*, 42*b*. The holder 50 comprises two pins 39*a*, 39*b* or 39*c*, 39*d* protruding into a recess 38*a*, 38*b* of the support 30 for fixing the ends of the corrugated longitudinal edges 42*a*, 42*b* of the overlay 40 at each end of the support 30. For fixation, the pins 39*a*, 39*b* are inserted into the holes 46*a*, 46*b*, and the pins 39*c*, 39*d* are inserted into the holes 45*a*, 45*b* of the overlay 40 as can be seen in FIG. 2 showing the fixed state.

For fixing the overlay 40 on the support 30 it is buttoned to the supporting connection pieces 51*b* to 51*d* at its longitudinal edge 42*b* according to the illustration shown in FIG. 3. The pins 39*b* and 39*d* of the support 30 are accommodated in the holes 46*b* or 45*b*. Then the overlay 40 is brought in a position shown in FIG. 2 in which the openings 44 are buttoned into the supporting connection pieces 51*a*, 51*c* and 51*d* in the wave crests of the longitudinal edges 42*a*.

Figure 2:
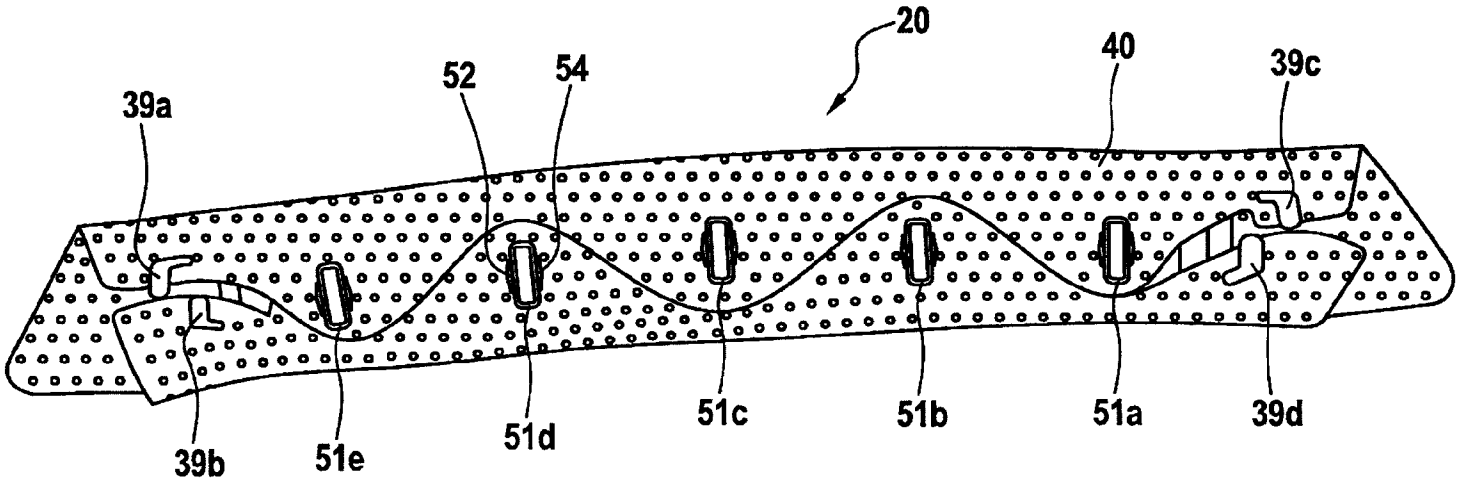
FIG. 2 shows the forehead band according to FIG. 1 in a rear view.

Finally, the pins 39*a*, 39*c* of the support 30 are inserted into the holes 46*a* or 45*a* so that the overlay 40 is fixed to the support 30 in the position shown in FIG. 2. In this state the forehead band 20 can be put into the washing machine for cleaning. However, the overlay 40 may also be removed from the support 30 and put into the washing machine as a separate part as shown in FIG. 4.

The overlay 40 consists of a textile material perforated by a plurality of small openings to render an air stream through the air apertures 36*a*-36*d* possible. In addition, the textile material is selected so that it has a good sweat absorbing capacity.

The support 30 is a flexible formed component made of a plastic material. In this way it is ensured that the support 30 can adapt to the curvature of the head band and that the tubular supporting connection pieces 51*a*-51*e* are, as such, sufficiently elastically flexible to render the engagement of the supporting connection pieces on the head band by means of the snap tabs 52, 54 possible.

LIST OF NUMERALS

20 forehead band
20' forehead band
30 support
32 front side
34 rear face
36*a* air aperture
36*b* air aperture
36*c* air aperture
36*d* air aperture
38*a* recess
38*b* recess
40' interior fitting assembly
40 overlay
42' support cage
42*a* longitudinal edge
42*b* longitudinal edge
44 opening
44' head band
45*a* hole
45*b* hole
46' neck band
46*a* hole
46*b* hole
50 holder
51*a* supporting connection piece
51*b* supporting connection piece
51*c* supporting connection piece
51*d* supporting connection piece
52 snap tab
54 snap tab
56' joint
H height

The invention claimed is:

1. A forehead band for attaching to a head band of an interior fitting assembly of a protective helmet, the forehead band comprising:

a strip-shaped support having a front side and a rear side opposite the front side, the front side facing away from the head band;

a plurality of connectors for releasably fixing the forehead band to the head band by non-positively or positively engaging a respective plurality of fitting openings disposed in the head band, the plurality of connectors being formed integrally with the support, each connector having a base joined to the rear side and a free end distal from the base and the rear side, each connector of the plurality of connectors comprising a substantially tubular shape and extending away from the rear side; and an overlay disposed over the support on the front side, the overlay comprising a sweat-absorbing material for absorbing sweat.

2. The forehead band according to claim 1, wherein the free end comprises an outwardly protruding snap tab, the respective connector being elastically resilient at the free end.

3. The forehead band according to claim 2, wherein the support comprises an air aperture, the air aperture is aligned with one of the openings of the head band between the free ends.

4. The forehead band according to claim 1, wherein the overlay comprises a textile blank.

5. The forehead band according to claim 4, wherein the overlay is disposed additionally on the rear side.

6. A forehead band for attaching to a head band of an interior fitting assembly of a protective helmet, the forehead band comprising:

a strip-shaped support having a front side and a rear side opposite the front side, the front side facing away from the head band;

a holder for releasably fixing the forehead band to the head band, the holder comprising a plurality of connectors, the plurality of connectors being integrally formed on the rear side of the support, the plurality of connectors for non-positively or positively engaging a respective plurality of fitting openings disposed in the head band, each connector of the plurality of connectors comprising a substantially tubular shape; and an overlay disposed over the support on the front side, the overlay comprising a sweat-absorbing material for absorbing sweat;

wherein the overlay comprises a textile blank;

wherein the overlay is disposed additionally on the rear side;

wherein the overlay comprises a first longitudinal edge and a second longitudinal edge, each longitudinal edge comprising a corrugation having at least one wave crest, the first longitudinal edge being corrugated complementarily relative to the second longitudinal edge, the at least one wave crests comprising an overlay opening for receiving one of the plurality of connectors.

7. The forehead band according to claim 6, wherein each longitudinal edge comprises a pair of end portions;

wherein each holder comprises two pins for protruding into a recess of the support, the pins for fixing the respective pair of end portions of the first longitudinal edge and the second longitudinal edge on each end of the support.

8. The forehead band according to claim 1, wherein the support comprises a plastic material for elastic flexibility of the support.

9. A protective helmet, the helmet comprising:

interior fitting assembly comprising a head band; and a forehead band for attaching to the head band, the forehead band comprising a strip-shaped support having a front side and a rear side opposite the front side, the front side facing away from the head band;

a plurality of connectors for releasably fixing the forehead band to the head band by non-positively or positively engaging a respective plurality of fitting openings disposed in the head band, the plurality of connectors being formed integrally with the support, each connector having a base joined to the rear side and a free end distal from the base and the rear side, each connector of the plurality of connectors comprising a substantially tubular shape and extending away from the rear side; and an overlay disposed over the support on the front side, the overlay comprising a sweat-absorbing material for absorbing sweat.

10. The helmet according to claim 9, wherein the free end of a respective connector comprises an outwardly protruding snap tab, the respective connector being elastically resilient at the free end.

11. The helmet according to claim 10, wherein the support comprises an air aperture, the air aperture being aligned with one of the fixing openings of the head band between the free ends.

12. The helmet according to claim 9, wherein the overlay comprises a textile blank.

13. The helmet according to claim 12, wherein the overlay is disposed additionally on the rear side.

14. The helmet of claim 13, wherein the overlay comprises a first longitudinal edge and a second longitudinal edge, each longitudinal edge comprising a corrugation having at least one wave crest, the first longitudinal edge being corrugated complementarily relative to the second longitudinal edge, the at least one wave crests comprising an overlay opening for receiving one of the plurality of connectors.

15. The helmet according to claim 14, wherein each longitudinal edge comprises a pair of end portions;

further comprising two pins for protruding into a recess of the support, the pins for fixing the respective pair of end portions of the first longitudinal edge and the second longitudinal edge on each end of the support.

16. The helmet according to claim 9, wherein the support comprises plastic for elastic flexibility.

* * * * *